US007107963B2

(12) United States Patent
Warfel et al.

(10) Patent No.: US 7,107,963 B2
(45) Date of Patent: Sep. 19, 2006

(54) IGNITION SYSTEMS FOR PORTABLE POWER TOOLS

(75) Inventors: Paul A. Warfel, Texarkana, TX (US); Rodney W. Tynes, Shreveport, LA (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 0 days.

(21) Appl. No.: 11/343,445

(22) Filed: Jan. 31, 2006

(65) Prior Publication Data

US 2006/0124098 A1 Jun. 15, 2006

Related U.S. Application Data

(62) Division of application No. 10/821,067, filed on Apr. 8, 2004, now Pat. No. 7,025,034.

(51) Int. Cl.
*F02D 9/10* (2006.01)
*F02D 9/02* (2006.01)

(52) U.S. Cl. ..... 123/198 DC

(58) Field of Classification Search ..... 123/198 E, 123/198 DC

See application file for complete search history.

(56) References Cited

U.S. PATENT DOCUMENTS

| | | | | |
|---|---|---|---|---|
| 2,791,207 | A | 5/1957 | Rayniak | |
| 3,823,700 | A | 7/1974 | Gumtow | |
| 4,286,675 | A | 9/1981 | Tuggle | |
| 4,841,929 | A * | 6/1989 | Tuggle et al. | 123/198 E |
| 4,919,091 | A | 4/1990 | Wissmann et al. | |
| 5,209,196 | A | 5/1993 | Nickel et al. | |
| 5,485,814 | A | 1/1996 | Tuggle et al. | |
| 6,395,049 | B1 | 5/2002 | Knodler et al. | |
| 6,550,749 | B1 | 4/2003 | Vick | |
| 6,612,275 | B1 | 9/2003 | Immel et al. | |
| 6,681,726 | B1 | 1/2004 | Linsbauer et al. | |

FOREIGN PATENT DOCUMENTS

| | | |
|---|---|---|
| CA | 949 627 A1 | 6/1974 |
| DE | 25 09 443 | 9/1976 |
| DE | 41 16 395 | 11/1992 |
| DE | 41 20 876 | 12/1992 |
| DE | 196 31 031 A1 | 2/1998 |
| DE | 196 31 033 A1 | 2/1998 |
| DE | 200 09 208 | 8/2000 |
| DE | 200 12 919 | 12/2001 |

* cited by examiner

*Primary Examiner*—Erick R Solis
(74) *Attorney, Agent, or Firm*—Pearne & Gordon LLP

(57) ABSTRACT

The cooperative operational relationship among an ignition switch, choke mechanism and air filter unit for a portable power tool are integrated in a way to improve that relationship. The ignition switch and choke mechanism are arranged in a coactive relationship wherein the ignition switch and a choke lever in the choke mechanism have engaging parts such that the ignition switch is moved to an "On" position by the choke lever when the choke lever is moved to a position where it has reduced the air flow to a carburetor. A spring engaging the ignition switch is biased for applying a force to the ignition switch in a direction toward a mounting element on which the ignition switch is mounted and away from the choke lever. In a particular embodiment, the ignition switch is mounted on the air filter unit.

43 Claims, 4 Drawing Sheets

IGNITION SYSTEMS FOR PORTABLE POWER TOOLS

CROSS REFERENCE

This application is a divisional of U.S. application Ser. No. 10/821,067, filed Apr. 8, 2004, now U.S. Pat. 7,025,034.

BACKGROUND OF THE INVENTION

The present invention relates, generally, to ignition systems for portable power tools and, in particular, to ignition systems that include an ignition switch, choke mechanism and air filter unit.

Portable power tools such as chain saws, hedge trimmers, edgers and blowers, typically, are powered by a gasoline engine the operation of which is controlled by an ignition switch. The ignition switch is manually movable between an "On" position allowing the engine to operate and an "Off" position preventing the engine from operating. Usually, these power tools are also provided with a manually controlled choke mechanism to facilitate the starting and running of the gasoline engine. The engine requires both fuel and air to operate and, by manipulating the choke mechanism, the relative quantities of air and fuel delivered to the engine are varied so that the engine can be readily started and, thereafter, operated. For example, if the engine has been idle for a period of time and the ambient temperature is relatively low, in order to start the engine, it is necessary that an air-fuel mixture that is rich in fuel be delivered to the engine with the ignition switch in the "On" position. To produce a fuel-rich air-fuel mixture the choke mechanism is adjusted so that it restricts the intake of air to the engine. Once the engine has started, the choke mechanism is adjusted once again so that the quantity of air, in relation to the quantity of fuel delivered to the engine, is increased until a ratio of air to fuel is attained that allows for optimum operation of the engine. At such time as it is desired to discontinue operating the power tool, the ignition switch is moved to the "Off" position.

The air and fuel are mixed in the engine's carburetor before being delivered to the engine and, typically, the choke mechanism controls the position of a valve in the flow path of the air to the carburetor so as to control the quantity of air entering the carburetor. Because it is important to the efficient operation of the engine that the air be as free of particulate matter as possible, the air is passed through an air filter unit before it is introduced into the carburetor.

SUMMARY OF THE INVENTION

From the foregoing it will be understood that there is a cooperative operational relationship among the ignition switch, the choke mechanism and the filter unit, as incorporated into and applied to the portable power tool and the present invention affords certain improvements in that operational relationship. Thus, according to the present invention, an air filter unit is provided on which the ignition switch is mounted. Additionally, the ignition switch and choke mechanism are arranged in a coactive relationship wherein the ignition switch and a choke lever in the choke mechanism are located adjacent one another and have engaging parts such that the ignition switch will be moved to an "On" position by the choke lever when the choke lever is moved to a position where it has reduced the air flow to the carburetor and caused the air-fuel mixture delivered to the engine to become fuel-rich. Also, the present invention provides for the integration of the coactive ignition switch and choke mechanism with the filter unit.

According to one aspect, the filter unit comprises a housing for holding an air filter, the housing having a port in communication with an inlet port in the carburetor for the passage of air from the housing to the carburetor. Means are included on the housing by which the housing may be secured to the portable power tool. Also included on the housing is a mounting element for the mounting thereon of the ignition switch for the portable power tool.

According to another aspect, the housing for holding the air filter includes a housing base and a housing cover for the housing base. The housing base includes a housing base floor that has ports through which air flows to the carburetor. The housing base floor also has means by which the housing base may be attached to the carburetor of the power tool. A housing base perimeter wall is integral with the housing base floor and extends, generally, perpendicularly from the perimeter of the housing base floor in the direction of the housing cover. The housing base perimeter wall has an inside surface and an outside surface, and the inside surface of the housing base perimeter wall and the housing base floor define a housing base interior. The housing base perimeter wall includes an anterior section, a posterior section, a first lateral section joining one terminus of the anterior section to one terminus of the posterior section and a second lateral section joining the other terminus of the anterior section to the other terminus of the posterior section such that the housing base perimeter wall, when the housing is installed in the portable power tool, has its anterior section nearest the front of the power tool, its posterior section nearest the rear of the power tool and its first and second lateral sections disposed toward opposite sides of the power tool. Integral with the first lateral section of the housing base perimeter wall is an augmentation that extends, substantially, perpendicularly from the housing base floor in a direction away from the housing cover. A pair of opposed support legs for securing the housing base to the chassis of the portable power tool are provided. A first of the opposed support legs is integral with the augmentation and the second of the opposed support legs is integral with the second lateral section of the housing base wall. A mounting element integral with the outside surface of the first lateral section of the housing base perimeter wall is provided for the mounting thereon of the ignition switch for the portable power tool.

According to yet another aspect, an ignition assembly for a portable power tool having a carburetor and an ignition circuit is provided. The assembly includes a choke lever connected to an air valve for controlling the flow of air to the carburetor. The choke lever is reciprocally movable between a first position in which air flow to the carburetor of the portable power tool is not substantially restricted and a second position in which air flow to the carburetor is substantially restricted. The choke lever includes a depending abutment. An ignition switch is positioned on a mounting element in the portable power tool so as to be movable between an "On", or run, position in which the power tool may be operated, and an "Off", or stop, position in which the power tool may not be operated. The ignition switch includes a depending abutment located in the line of reciprocal movement of the depending abutment of the choke lever when the ignition switch is in the stop position so that reciprocal movement of the choke lever from its first position to its second position causes the depending abutment on the choke lever to engage the depending abutment on the ignition switch and move the ignition switch from the stop position to the run position. The assembly also includes a leaf spring that engages the ignition switch at a first site of engagement on the ignition switch when the ignition switch is in the stop position and at a second site of engagement on the ignition switch when the ignition switch is in the run position. The leaf spring is biased for alternatively applying a force to the ignition switch at the first and second sites of engagement in a direction toward the mounting element and away from the choke lever.

According to further aspects, the ignition assembly as described above includes, separately or in combination, the following features: The ignition switch is positioned on the mounting element for pivotal movement between the run position and the stop position. The leaf spring is, generally, S-shaped and has an intermediate section, a first terminal section connected to one end of the intermediate section of the leaf spring and a second terminal section connected to the other end of the intermediate section of the leaf spring. The leaf spring is held in place on the power tool at the intermediate section and the first terminal section of the leaf spring alternatively engages the ignition switch at the first and second sites of engagement on the ignition switch as the ignition switch is moved between the stop position and the run position. The leaf spring forms a part of the ignition circuit, and the continuity of the ignition circuit is established when the first terminal section of the leaf spring engages the ignition switch at the first site of engagement and the continuity of the ignition circuit is interrupted when the first terminal section of the leaf spring engages the ignition switch at the second site of engagement. The second terminal section of the leaf spring is connected to the ignition circuit and the ignition switch includes an electrical conductor located at the first site of engagement on the ignition switch and also connected to the ignition circuit. The first terminal section of the leaf spring includes a rounded protuberance that alternately engages the ignition switch at the first and second sites of engagement. The ignition switch includes a, substantially, circular opening and the electrical conductor comprises an annulus that is press-fitted in the substantially circular opening. Positioning means are located adjacent the substantially circular opening in the ignition switch for maintaining the electrical conductor in place in the substantially circular opening in the ignition switch.

According to still another aspect, the ignition assembly, as described above, is brought together and integrated with the filter unit, by mounting the ignition switch of the ignition assembly on the mounting element located on the filter housing base of the filter unit.

According to yet other aspects, the mounting element comprises a, generally, cylindrical projection and the ignition switch is mounted for pivotal movement on the cylindrical projection between a position placing the power tool in an "Off", or non-operating, mode and a position placing the tool in an "On", or operating mode. The housing includes a stop lug adjacent the cylindrical projection for limiting the pivotal movement of the ignition switch beyond the position placing the power tool in an operating mode and a guide lug adjacent the stop lug for providing a guiding surface for the choke lever. A pair of positioning elements are included on the filter housing adjacent the mounting element, the positioning elements being separated from one another so as to establish a space into which may be positioned the intermediate section of the S-shaped leaf spring. Each positioning element has an engaging surface adapted to engage the S-shaped leaf spring at a respective location at which the intermediate section of the S-shaped leaf spring is joined to a terminal section of the S-shaped leaf spring.

According to an additional aspect, the air filter housing cover rests on the air filter housing base and the air filter housing cover includes a depending portion that extends downwardly over the housing base so as to protect electrical wiring components connected to the terminal sections of the leaf spring. In the case where the housing base includes a housing base floor and anterior and first and second lateral perimeter wall sections, the depending section extends downwardly over the anterior section of the housing base perimeter wall where the anterior section is joined to the first lateral section of the housing base perimeter wall and beyond the housing base floor.

According to yet another aspect, access holes are provided through a support leg for the air filter housing to provide access to the needles on the carburetor.

BRIEF DESCRIPTION OF THE DRAWINGS

The foregoing and other features of the present invention will be apparent from the description below with reference to the drawings wherein.

DETAILED DESCRIPTION OF THE INVENTION

Figure 1:
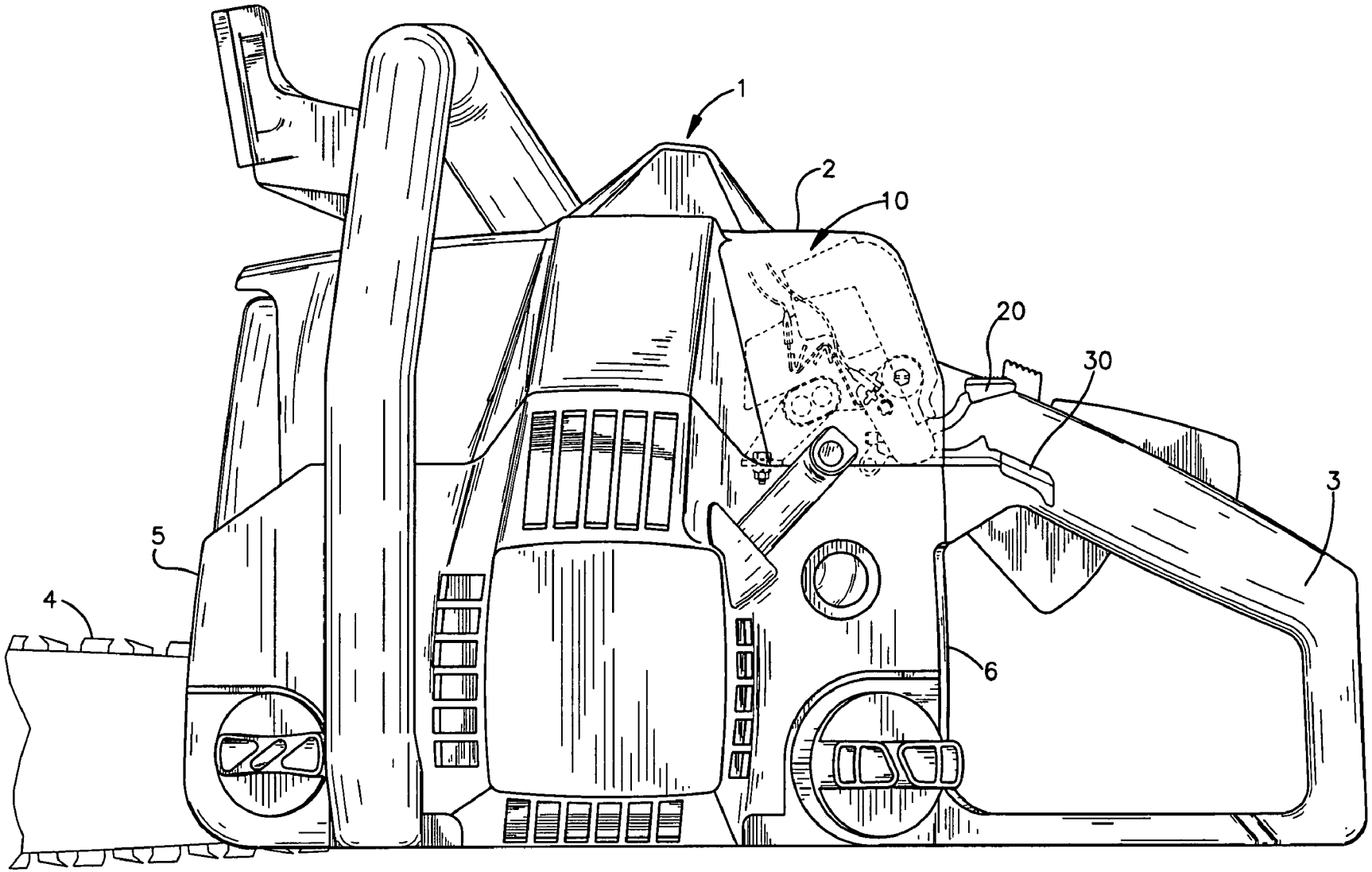
FIG. 1 is a side view of a chain saw incorporating the present invention.

FIG. 1 illustrates the invention, indicated generally at 10, incorporated into a chain saw indicated generally at 1. Although the invention is described in detail herein as used with a chain saw it may be applied to other types of power tools, including portable power tools such as, for example, hedge trimmers, edgers and blowers. As shown in FIG. 1, the invention is located within the confines of the outer cover 2 of the chain saw.

In general, the invention relates to an ignition system that includes an ignition switch, a choke mechanism and a filter unit. The ignition switch includes a lever 20 and the choke mechanism includes a lever 30, both of which extend outside the outer cover 2 of the chain saw. The levers 20 and 30 are provided to enable the operator of the chain saw to readily manipulate the ignition switch and the choke mechanism, respectively, and both levers are positioned near the handle 3 of the chain saw for easy access by the operator.

Figure 2:
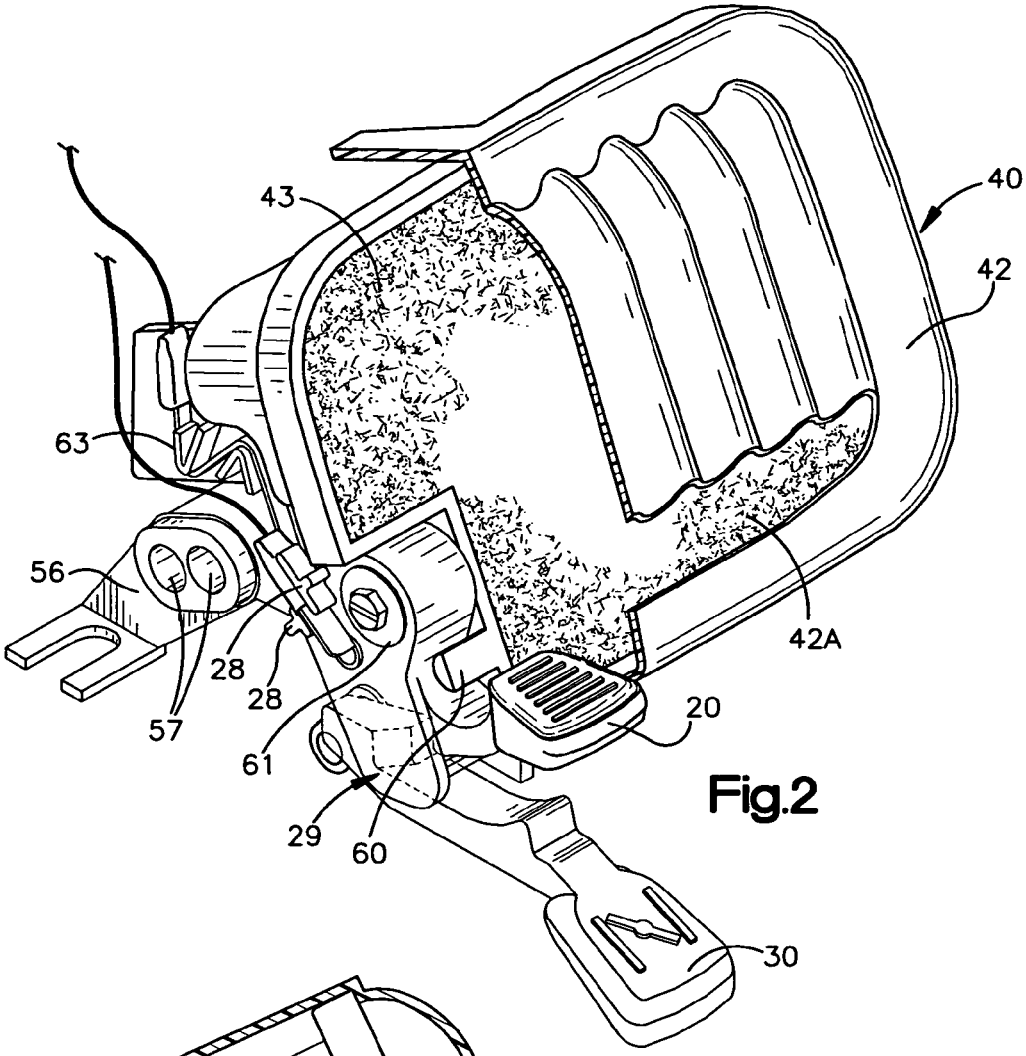
FIG. 2 is a perspective view of the invention with a portion of the filter housing cover broken away to illustrate the filter.
Figure 3:
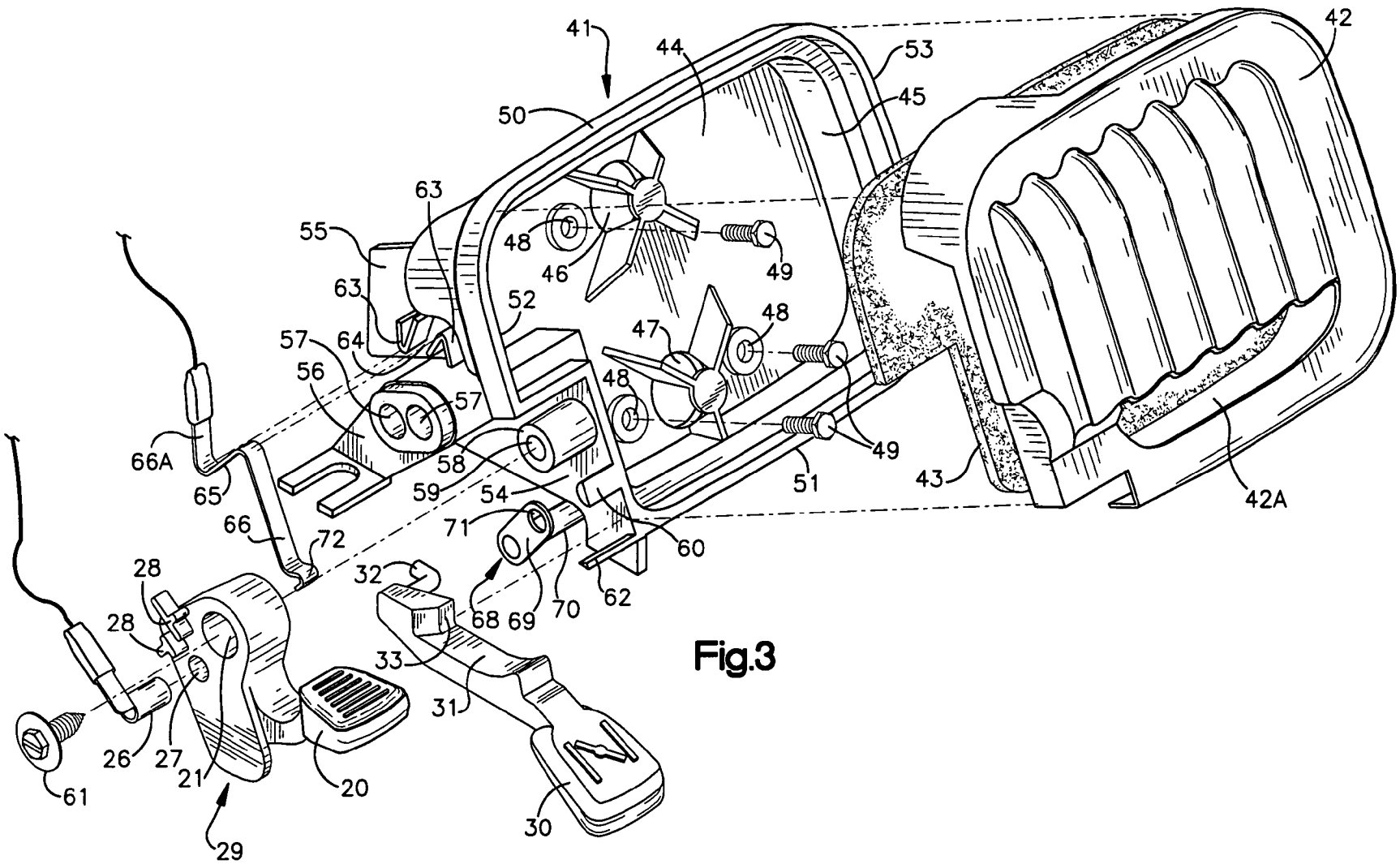
FIG. 3 is an exploded view of the invention.

The filter unit of the ignition system of the invention is best described with reference to FIGS. 2 and 3 of the drawings. As illustrated in these figures, the filter unit includes a filter housing, indicated generally at 40, and a filter 43 disposed within the housing. The filter housing comprises a filter housing base, indicated generally at 41, and a filter housing cover 42. The filter housing and the filter cover can be made of any of a variety of suitable materials such as, for example, metals, heat-resistant composites or plastics. In the presently described embodiment, the filter housing base 41 and filter housing cover 42 are made of a hardened plastic and are configured so that the cover can be both snapped tightly onto the housing base and unsnapped from the housing base in a manner that is familiar to those having ordinary skill in the art.

The filter housing base 41 includes a filter housing base floor 44 and a filter housing base perimeter wall 45. The base floor 44 includes ports 46 and 47 that are in fluid communication with inlet ports in the chain saw carburetor (not shown) whereby air entering the filter housing through opening 42 A in the filter housing cover 42 and passing through filter 43 is drawn into the carburetor. Air entering the carburetor through port 47 mixes with fuel injected into the carburetor and the air-fuel mixture is delivered to the chain saw's engine where combustion of the fuel takes place. Air entering the carburetor through port 46 does not mix with fuel and is, simply, directed to the engine where it contributes to the combustion of the air-fuel mixture delivered to the engine. The arrangement of the carburetor with the engine and the manner in which the engine drive shaft drives the chain saw blade 4 are, essentially, independent of the present invention and, consequently, are not described here. Various methods and designs for performing these functions are well known to those skilled in the art.

The filter housing base floor 44 also is provided with several openings 48 through which the threaded portions, but not the heads, of the fasteners 49 can pass. The fasteners are screwed into complementary threaded holes in the carburetor, and this arrangement constitutes the means by which the filter housing base 41 is attached to the carburetor.

The filter housing base perimeter wall 45 is integral with the housing base floor 44 and extends, generally, perpendicularly from the perimeter of the housing base floor in the direction of the filter housing cover 42. As is best seen in FIG. 3, the housing base perimeter wall has an inside surface and an outside surface with the inside surface of the perimeter wall and the housing base floor 44 defining a housing base interior.

The housing base perimeter wall includes an anterior section 50, a posterior section 51, a first lateral section 52 and a second lateral section 53. The first lateral section 52 joins one terminus of the anterior section 50 to one terminus of the posterior section 51, and the second lateral section 53 joins the other terminus of the anterior section 50 to the other terminus of the posterior section 51. Consequently, when installed in the chain saw, the anterior section is nearest the front 5 of the chain saw, the posterior section is nearest the rear 6 of the chain saw and the first and second lateral sections are disposed toward opposite sides of the chain saw.

In the embodiment of the invention shown in the drawings, the portion 54 of the first lateral section 52 of the filter housing base perimeter wall that is adjacent the posterior section 51 of the perimeter wall is recessed inwardly toward the housing base interior. Integral with the first lateral section 52 of the housing base perimeter wall is an augmentation, or extension, 55 that extends, substantially, perpendicularly from the filter housing base floor 44 in a direction away from the housing base cover 42. Further, the augmentation 55 and the recessed portion 54 of the first lateral section of the housing base perimeter wall are located in substantially the same plane as can best be seen in FIGS. 2 and 3. Although the embodiment of the invention illustrated in the drawings includes a recessed portion 54 on the first lateral section 52 of the housing base perimeter wall, it is not essential that the first lateral section be recessed.

Figure 4:
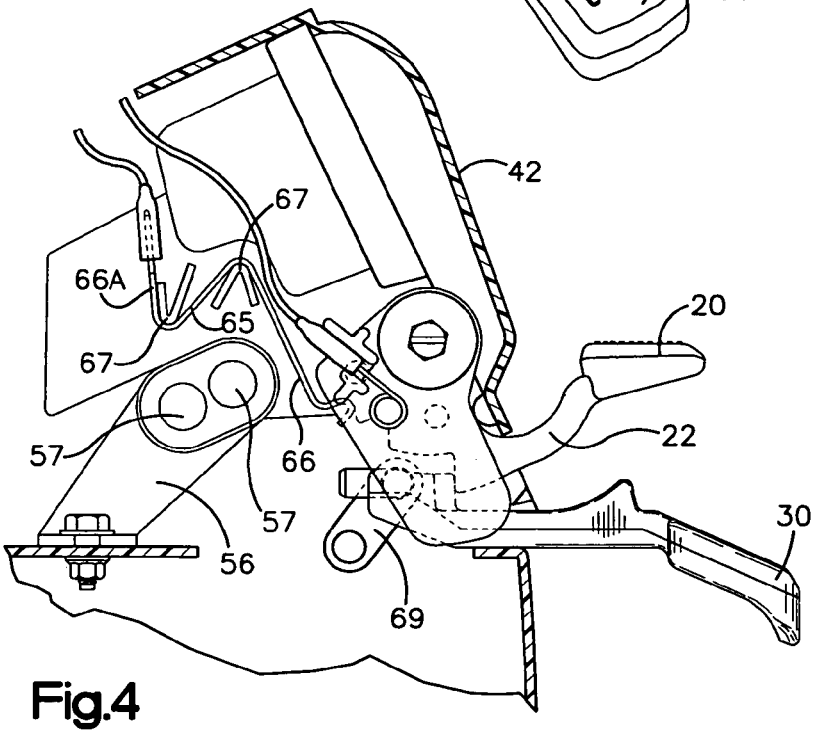
FIG. 4 is a side view of the invention shown mounted to the chain saw chassis and with the chassis and filter housing cover shown in cross section.
Figure 5:
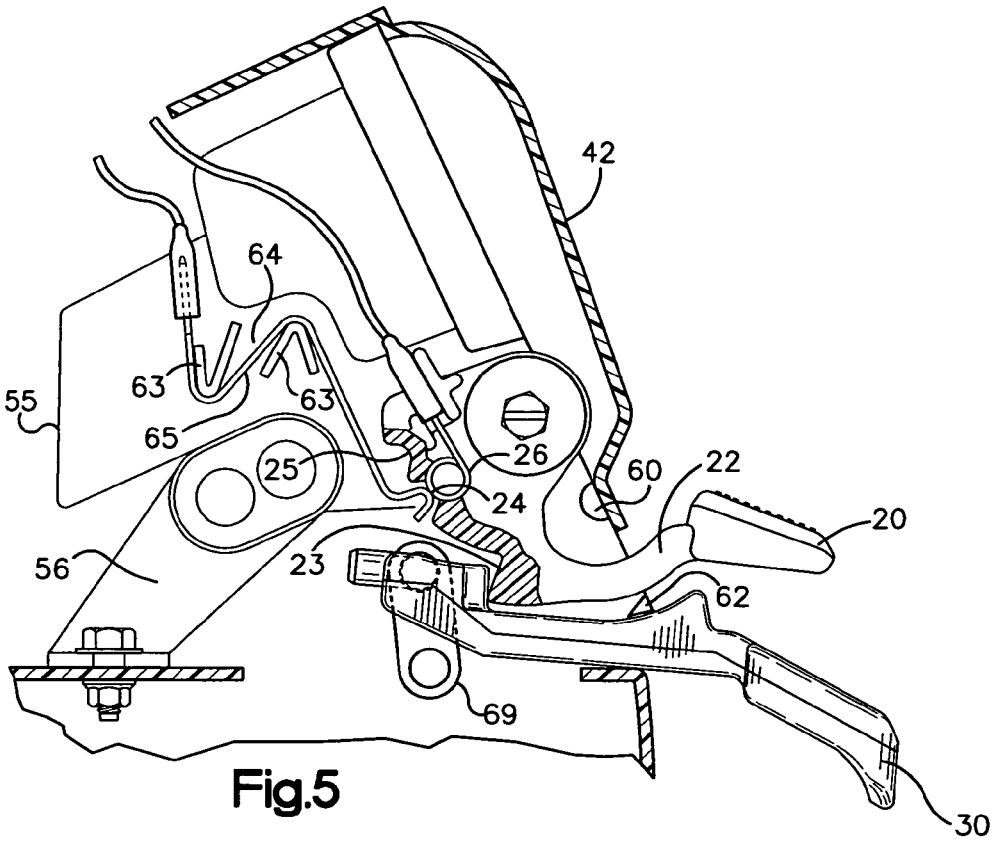
FIG. 5 is a side view of the invention shown mounted to the chain saw chassis, with the chassis and filter housing cover shown in cross section and with a portion of the ignition switch broken away to illustrate the arrangements of certain parts of the invention when the ignition system is in an "Off" position.
Figure 6:
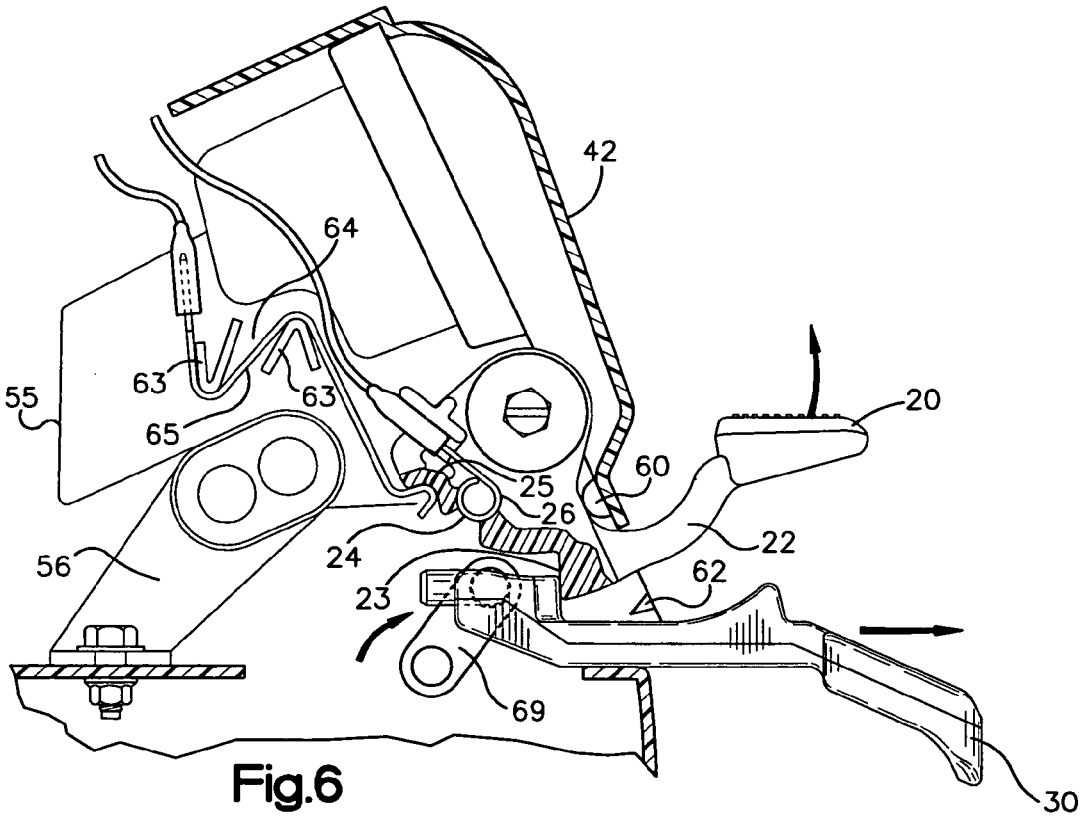
FIG. 6 is a side view of the invention shown mounted to the chain saw chassis, with the chassis and filter housing cover shown in cross section and with a portion of the ignition switch broken away to illustrate the arrangements of certain parts of the invention when the ignition system is in an "On" position.

The filter unit additionally includes a pair of opposed support legs that are positioned on the housing base 41. The first opposed support leg 56, as shown in FIGS. 2 and 3, is integral with the augmentation 55. The second of the opposed support legs is structurally, essentially, the same as the first of the opposed support legs, is integral with the second lateral section 53 of the housing base perimeter wall and is located on the second lateral section 53 directly opposite support leg 56. The opposed support legs secure the filter housing base to the chassis of the chain saw, with the cooperation of suitable fasteners, as shown in FIGS. 4, 5 and 6 and, thus, comprise a means on the filter housing by which the housing may be secured to the chain saw.

First opposed support leg 56 includes a pair of openings 57 that extend through the leg and the augmentation 55 with which the leg is integral. The openings are aligned with the needles of the carburetor and, thus, provide access holes to the needles for the purpose of adjusting the carburetor.

The filter housing base also includes a mounting element for the mounting thereon of the ignition switch for the chain saw. Specifically, the mounting element 58 is integral with the outside surface of the first lateral section 52 of the housing base perimeter wall. As shown in the embodiment of the invention illustrated in the drawings, the mounting element 58 is located on the recessed portion 54 of the first lateral section of the housing base perimeter wall.

The mounting element 58 comprises a, generally, cylindrical projection that extends, generally, perpendicularly from the first lateral section of the filter housing base perimeter wall outwardly of the housing base interior. The ignition switch, indicated generally at 29, includes a, generally, cylindrical opening 21 that extends through the switch. The opening 21 is congruent with the cylindrical mounting element 58 and provides the means by which the ignition switch is mounted on the mounting element for pivotal movement between a position placing the chain saw in a non-operating mode, i.e., the "Off" position, as illustrated in FIG. 5, and an operating mode, i.e., the "On" position, as illustrated in FIG. 6. The ignition switch 29 is secured to the mounting element 58 by the fastener 61 with the fastener being threaded into the threaded axial hole 59 in the mounting element. The fastener is not driven into axial hole 59 far enough to interfere with the pivotal movement of the ignition switch 29 on the mounting element 58.

To assist in preventing the ignition switch 29 from proceeding in its pivotal movement beyond the "On" position as shown in FIG. 5, a stop lug 60 is provided on the filter housing adjacent the cylindrical projection 58. As shown in the embodiment illustrated in the drawings, the stop lug is integral with the outer surface of the first lateral section 52 of the filter housing perimeter wall, specifically the recessed portion 54 of the first lateral section 52, and is located between the cylindrical projection 58 and the posterior section 51 of the housing base perimeter wall. As best shown in FIGS. 4 and 6, the arm 22 of the ignition switch engages the stop lug 60 to prevent the ignition switch from moving beyond the "On" position.

The filter housing also includes a guide lug 62 adjacent the stop lug 60 for providing a guiding surface for the choke lever 30. As shown in the embodiment illustrated in the drawings, the guide lug 62 is integral with the outer section of the first lateral section 52 of the filter housing base perimeter wall, specifically the recessed portion of the first lateral section, and is located between the stop lug 60 and the posterior section 51 of the housing base perimeter wall. The lever arm 31 of the choke lever 30, as the choke lever is pulled outwardly of the chain saw from the "Off" position shown in FIG. 5 to the "On" position shown in FIG. 6, will tend to be guided along the guide lug 62.

Also included on the filter housing is a pair of positioning elements 63 located, generally, adjacent the mounting element 58. In the embodiment of the invention illustrated in the drawings, the positioning elements are integral with the augmentation 55 and are located forwardly of the mounting element 58. The positioning elements are separated from one another so as to establish a space 64 in which is located the intermediate section 65 of an S-shaped leaf spring. Joined to each end of the intermediate section of the leaf spring is a first terminal section 66 and second terminal section 66A of the leaf spring, respectively. Each positioning element has an engaging surface 67 that engages the S-shaped leaf spring at a respective location at which the intermediate section 65 of the S-shaped leaf spring is joined to a terminal section 66 and 66A of the S-shaped leaf spring.

The foregoing description is directed, largely, to the structure of the air filter housing and to the interrelationship between the housing and the ignition switch and the choke lever. What follows is a more detailed description of the ignition switch and the choke lever and the manner in which the ignition switch and the choke mechanism, including the choke lever, function, particularly as they function in cooperation with the filter housing of the invention.

The choke lever of the choke mechanism and the ignition switch function cooperatively as an ignition assembly for the chain saw in conjunction with a chain saw ignition circuit. The operation of an ignition circuit of a power tool such as a chain saw is well known to those skilled in the art. In general, the ignition circuit includes an ignition module that develops electrical current pulses in response to the rotation of a permanent magnet past the ignition module. Typically, the magnet is mounted on a flywheel that is caused to operate by an operator pulling on a rope starter attached to the flywheel. The current pulses are transmitted to a spark plug that generates sparks in response to the current pulses. The sparks, in turn, ignite the air-fuel mixture that has been delivered to the engine of the chain saw by the carburetor. The ignition module is connected by ground wires to the engine and by a lead wire to the ignition switch, as will be more fully described below. It may be noted here, however, that when the ignition switch is in the "Off" position, the ignition module is grounded and does not provide current pulses to the spark plug. On the other hand, when the ignition switch is in the "On" position the ignition switch is not grounded and is able to deliver current pulses to the spark plug.

With reference to the drawings, it can be seen that the chain saw is provided with a choke mechanism that includes the choke lever 30 and a valve lever indicated, generally, at 68. The valve lever includes an arm 69, provided with a hole 71, and a rod 70. The rod is connected to a butterfly valve, not shown, that is located in the air passageway between the port 47 and the associated inlet port in the carburetor. As will be understood by those skilled in the art, rotation of the rod 70 in one direction causes the butterfly valve to open while rotation of the rod 70 in the other direction causes the butterfly valve to close. The choke lever 30 includes a hook-like projection 32 that is disposed within the hole 71 in the arm 69 so that longitudinal movement of the choke lever 30 will cause the arm 69 to move between the positions shown in FIG. 5 and FIG. 6, respectively. In turn, this movement of the arm causes rod 70 to rotate and that rotation will cause the butterfly valve located in the passageway between port 47 and the associated inlet port in the carburetor to open and close. FIG. 5 illustrates the arrangement that exists when the choke lever 30 is in a forward position and the butterfly valve is open and FIG. 6 illustrates the arrangement that exists when the choke lever has been pulled outwardly and is in a rearward position and the butterfly valve is closed. It will be understood to those skilled in the art that the nature of the mechanical connection between the choke lever and the valve that controls the air flow through the filter housing into the carburetor may vary and need not be of the type specifically described.

From the foregoing it can be seen that the choke lever 30 is connected to an air valve for controlling the flow of air to the carburetor and that the lever is reciprocally movable between a first position, as shown in FIG. 5, in which air flow to the carburetor of the chain saw is not substantially restricted, and a second position as shown in FIG. 6, in which air flow to the carburetor is substantially restricted. The choke lever also includes an abutment 33, the purpose of which is described below.

A butterfly valve is also located in the air flow path between port 46 in the filter base and the corresponding inlet port in the carburetor. The operation of this valve, however, is independent of the choke mechanism and is controlled by the chain saw's throttle mechanism in a manner familiar to those skilled on the art. It should be noted that the operation of the chain saw does not require a second air inlet such as port 46 and a corresponding inlet port in the carburetor.

The ignition switch 29, which also forms a part of the ignition assembly of the invention as has been described, is positioned on the mounting element 58 so as to be movable between the "Off", or stopping, position in which the chain saw cannot be operated and the "On", or running, position in which the chain saw can be operated. In general, the arrangement of the ignition switch in the stopping position is shown in FIG. 5 and the arrangement of the ignition switch in the running position is shown in FIG. 6. As can best be seen from these two figures, the ignition switch includes a depending abutment 23 that is located in the line of reciprocal movement of the depending abutment 33 of the choke lever when the ignition switch is in the stopping position so that reciprocal movement of the choke lever from its first position, when air flow to the carburetor is not substantially restricted, to its second position, when air flow to the carburetor is substantially restricted, causes the depending abutment 33 on the choke lever to engage the depending abutment 23 on the ignition switch and pivotally move the ignition switch on the mounting element 58 from the stopping position to the running position. It should be understood that it is not required that the ignition switch be mounted for pivotal movement on a mounting element that is integral with the air filter housing, and the ignition switch can be variously mounted to a mounting element in the chain saw or other power tool, the important consideration being that the choke lever moves the ignition switch from the "Off" position to the "On" position when the choke lever moves from its first position to its second position.

The ignition assembly also includes the S-shaped leaf spring which, as described above, is held in place on the filter housing at its intermediate section 65. The first terminal section 66 of the leaf spring includes a rounded protuberance 72 that engages the ignition switch at a first site of engagement 24 on the ignition switch when the ignition switch is in the "Off" position and engages the ignition switch at a second site of engagement 25 on the ignition switch when the ignition switch is in the "On" position. As can be seen, in particular from FIGS. 5 and 6 of the drawings, the S-shaped leaf spring is biased for alternatively applying a force to the ignition switch at the first and second sites of engagement in a direction toward the mounting element 58 and away from the choke lever 30. It will be understood that the leaf spring need not be S-shaped or include a rounded protuberance and other arrangements can be employed so that a force on the ignition switch directed toward the mounting element is provided and so that engagement by that force is made at two engagement sites on the ignition switch.

As shown in the embodiment of the invention illustrated in the drawings, the leaf spring forms a part of the ignition circuit described above and the continuity of the ignition circuit is established when the first terminal section 66 of the leaf spring engages the ignition switch at the first site of engagement and the continuity of the ignition switch is interrupted when the first terminal section 66 of the leaf spring engages the ignition switch at the second site of engagement. This is accomplished in the embodiment of the invention illustrated in the figures by the connection 74 between the second terminal section 66A of the leaf spring and the ignition circuit, on the one hand, and the connection between the electrical conductor 26, in the shape of an annulus, that is located at the first site of engagement 24 on the ignition switch 29 and the ignition circuit on the other hand. The ignition switch 29 includes an opening 27 that extends through the ignition switch, and the annular conductor 26 is press-fitted into the opening 27. The ignition switch also has positioning means 28 that are located adjacent opening 27 for maintaining the electrical conductor 26 in place on the ignition switch 29.

From the foregoing description it will be understood that the present invention will function in conjunction with a portable chain saw as follows: Initially, the ignition switch 29 will be in the "Off" position and the chain saw will be in the non-operational mode. At the same time, the choke lever 30 will be in a forward position. This state of affairs is best seen in FIG. 5. As shown in FIG. 5, the rounded protuberance 72 of the S-shaped leaf spring will be engaging the ignition switch at the first site of engagement 24 on the ignition switch and will be in contact with conductor 26. Under these circumstances, the coninuity of the chain saw's ignition circuit will be established and the ignition module in the ignition circuit will be grounded. As a result, the ignition module will not provide current pulses to the spark plug. When it is desired to start and operate the chain saw, and conditions are such that a fuel-rich air-fuel mixture is required, the choke level 30 is pulled outwardly of the chain saw in the direction of the arrow in FIG. 6 thereby rotating arm 68 in the direction of the arrow in FIG. 6 and causing rod 70 to actuate the butterfly valve located between port 47 in the air filter housing base and the air inlet in the carburetor and, substantially, close the valve. As that occurs, the abutment 33 on the choke lever, by engaging the abutment 23 on the ignition switch, will cause the ignition switch to pivot about mounting element 58 in the direction of the arrow in FIG. 6. As a result, the rounded protuberance 72 on the first terminal section 66 of the S-shaped leaf spring, because the leaf spring is biased so as to provide an upward force to the ignition switch toward the mounting element, will engage the second engagement site 25 on the ignition switch. This arrangement is illustrated in FIG. 6. At this point, the protuberance 72, and consequently the S-shaped leaf spring, will be out of contact with conductor 26 and the continuity of the ignition circuit will be interrupted. Therefore, the ignition module will no longer be grounded so that the ignition module will be able to provide current pulses to the spark plug causing the spark plug to emit sparks that will ignite the air-fuel mixture in the engine and place the chain saw in an operating mode. As the engine begins to run, the choke lever can be adjusted to any position required for the engine to finally attain its optimum operating speed without affecting the position of the ignition switch. Normally, the choke lever will be returned to its inward-most location which coincides with the butterfly valve being positioned so as to permit the substantially unrestricted flow of air to pass through the filter housing to the carburetor.

While a presently preferred embodiment of the invention has been shown and described herein, it is to be understood that the invention is not so limited but covers and includes any and all modifications and variations that are encompassed by the following claims.

What is claimed is:

1. An ignition assembly for a portable power tool having a carburetor and an ignition circuit comprising:

a choke lever connected to an air valve for controlling the flow of air to the carburetor, the choke lever being reciprocally movable between a first position in which air flow to the carburetor of the portable power tool is not substantially restricted and a second position in which air flow to the carburetor is substantially restricted, the choke lever including a depending abutment;

an ignition switch positioned on a mounting element in the portable power tool so as to be movable between a run position in which the power tool may be operated and a stop position in which the power tool may not be operated, the ignition switch including a depending abutment located in the line of reciprocal movement of the depending abutment of the choke lever when the ignition switch is in the stop position so that reciprocal movement of the choke lever from the first position to the second position causes the depending abutment on the choke lever to engage the depending abutment on the ignition switch and move the ignition switch from the stop position to the run position; and a leaf spring engaging the ignition switch at a first site of engagement on the ignition switch when the ignition switch is in the stop position and engaging the ignition switch at a second site of engagement on the ignition switch when the ignition switch is in the run position, the leaf spring being biased for alternatively applying a force to the ignition switch at the first and second sites of engagement in a direction toward the mounting element and away from the choke lever.

2. The ignition assembly of claim 1, wherein the ignition switch is positioned on the mounting element for pivotal movement between the run position and the stop position.

3. The ignition assembly of claim 2, wherein the leaf spring is, generally, S-shaped and has an intermediate section, a first terminal section connected to one end of the intermediate section of the leaf spring and a second terminal section connected to the other end of the intermediate section of the leaf spring, the leaf spring being held in place on the power tool at the intermediate section and the first terminal section of the leaf spring alternatively engaging the ignition switch at the first and second sites of engagement on the ignition switch as the ignition switch is moved between the run position and the stop position.

4. The ignition assembly of claim 3, wherein the leaf spring forms a part of the ignition circuit, and the continuity of the ignition circuit is established when the first terminal section of the leaf spring engages the ignition switch at the first site of engagement and the continuity of the ignition circuit is interrupted when the first terminal section of the leaf spring engages the ignition switch at the second site of engagement.

5. The ignition assembly of claim 4, wherein the second terminal section of the leaf spring is connected to the ignition circuit and the ignition switch includes an electrical conductor located at the first site of engagement on the ignition switch and connected to the ignition circuit.

6. The ignition assembly of claim 5, wherein the first terminal section of the leaf spring includes a rounded protuberance that alternately engages the ignition switch at the first and second sites of engagement.

7. The ignition assembly of claim 6, wherein the ignition switch includes a, substantially, circular opening and the electrical conductor comprises an annulus that is press-fitted in the substantially circular opening.

8. The ignition assembly of claim 7, including positioning means located adjacent the substantially circular opening in the ignition switch for maintaining the electrical conductor in place in the substantially circular opening in the ignition switch.

9. An ignition system for a portable power tool having a carburetor and an ignition circuit comprising:

a housing for holding an air filter, the housing having a port in communication with a port in the carburetor for the passage of air from the housing to the carburetor;

means on the housing by which the housing may be secured to the portable power tool, and a mounting element on the housing for the mounting thereon of an ignition switch for the portable power tool;

a choke lever connected to an air valve for controlling the flow of air to the carburetor, the choke lever being reciprocally movable between a first position in which air flow to the carburetor of the portable power tool is not substantially restricted and a second position in which air flow to the carburetor is substantially restricted, the choke lever including a depending abutment;

an ignition switch positioned on the mounting element so as to be movable between a run position in which the power tool may be operated and a stop position in which the power tool may not be operated, the ignition switch including a depending abutment located in the line of reciprocal movement of the depending abutment of the choke lever when the ignition switch is in the stop position so that reciprocal movement of the choke lever from the first position to the second position causes the depending abutment on the choke lever to engage the depending abutment on the ignition switch and move the ignition switch from the stop position to the run position; and a leaf spring engaging the ignition switch at a first site of engagement on the ignition switch when the ignition switch is in the stop position and engaging the ignition switch at a second site of engagement on the ignition switch when the ignition switch is in the run position, the leaf spring being biased for alternatively applying a force to the ignition switch at the first and second sites of engagement in a direction toward the mounting element and away from the choke lever.

10. The ignition system of claim 9, wherein the mounting element comprises a, generally, cylindrical projection that extends, generally, perpendicularly from the housing laterally of the power tool for the mounting thereon of the ignition switch for pivotal movement between a position placing the power tool in a non-operating mode and a position placing the tool in an operating mode.

11. The ignition system of claim 10, including a pair of positioning elements on the housing adjacent the mounting element, the positioning elements being separated from one another so as to establish a space into which may be positioned the intermediate section of an S-shaped leaf spring to which is joined at each end of the intermediate section of the leaf spring a respective terminal section, each positioning element having an engaging surface adapted to engage the S-shaped leaf spring at a respective location at which the intermediate section of the S-shaped leaf spring is joined to a terminal section of the S-shaped leaf spring.

12. The ignition system of claim 11, wherein the leaf spring forms a part of the ignition circuit, and the continuity of the ignition circuit is established when the first terminal section of the leaf spring engages the ignition switch at the first site of engagement and the continuity of the ignition circuit is interrupted when the first terminal section of the leaf spring engages the ignition switch at the second site of engagement.

13. The ignition system of claim 12, wherein the second terminal section of the leaf spring is connected to the ignition circuit and the ignition switch includes an electrical conductor located at the first site of engagement on the ignition switch and connected to the ignition circuit.

14. The ignition system of claim 13, wherein the first terminal section of the leaf spring includes a rounded protuberance that alternately engages the ignition switch at the first and second sites of engagement.

15. The ignition system of claim 14, wherein the ignition switch includes a, substantially, circular opening and the electrical conductor comprises an annulus that is press-fitted in the substantially circular opening.

16. The ignition system of claim 15, including positioning means located adjacent the substantially circular opening in the ignition switch for maintaining the electrical conductor in place in the substantially circular opening in the ignition switch.

17. The ignition system of claim 16, including a stop lug for limiting the pivotal movement of the ignition switch beyond the position placing the power tool in the run position, the stop lug being integral with the housing and located adjacent the cylindrical projection.

18. The ignition system of claim 17, including a guide lug integral with the housing and located adjacent the stop lug for providing a guiding surface for the carburetor choke lever.

19. The ignition system of claim 18, wherein the housing includes a housing base and a housing cover that rests on the housing base and includes a depending portion that extends downwardly over the housing base so as to protect the electrical wiring components connected to the first and second terminal sections of the leaf spring.

20. The ignition system of claim 9, wherein the means on the housing by which the housing may be secured to the portable power tool includes a pair of opposed support legs attached to the housing at each of one of their respective ends, each of the other of their respective legs being adapted to be fastened to the power tool.

21. The ignition system of claim 20, wherein the mounting element comprises a, generally, cylindrical projection that extends, generally, perpendicularly from the housing laterally of the power tool for the mounting thereon of the ignition switch for pivotal movement between a position placing the power tool in a non-operating mode and a position placing the tool in an operating mode.

22. The ignition system of claim 21, including a pair of positioning elements on the housing adjacent the mounting element, the positioning elements being separated from one another so as to establish a space into which may be positioned the intermediate section of an S-shaped leaf spring to which is joined at each end of the intermediate section of the leaf spring a respective terminal section, each positioning element having an engaging surface adapted to engage the S-shaped leaf spring at a respective location at which the intermediate section of the S-shaped leaf spring is joined to a terminal section of the S-shaped leaf spring.

23. The ignition system of claim 22, wherein the leaf spring forms a part of the ignition circuit, and the continuity of the ignition circuit is established when the first terminal section of the leaf spring engages the ignition switch at the first site of engagement and the continuity of the ignition circuit is interrupted when the first terminal section of the leaf spring engages the ignition switch at the second site of engagement.

24. The ignition system of claim 23, wherein the second terminal section of the leaf spring is connected to the ignition circuit and the ignition switch includes an electrical conductor located at the first site of engagement on the ignition switch and connected to the ignition circuit.

25. The ignition system of claim 24, wherein the first terminal section of the leaf spring includes a rounded protuberance that alternately engages the ignition switch at the first and second sites of engagement.

26. The ignition system of claim 25, wherein the ignition switch includes a, substantially, circular opening and the electrical conductor comprises an annulus that is press-fitted in the substantially circular opening.

27. The ignition system of claim 26, including positioning means located adjacent the substantially circular opening in the ignition switch for maintaining the electrical conductor in place in the substantially circular opening in the ignition switch.

28. The ignition system of claim 27, including a stop lug for limiting the pivotal movement of the ignition switch beyond the position placing the power tool in the run position, the stop lug being integral with the housing and located adjacent the cylindrical projection.

29. The ignition system of claim 28, including a guide lug integral with the housing and located adjacent the stop lug for providing a guiding surface for the carburetor choke lever.

30. The ignition system of claim 29, wherein the housing includes a housing base and a housing cover that rests on the housing base and includes a depending portion that extends downwardly over the housing base so as to protect the electrical wiring components connected to the first and second terminal sections of the leaf spring.

31. An ignition system for a portable power tool having a carburetor and an ignition circuit comprising:

a housing for holding an air filter, the housing including a housing base and a housing cover for the housing base, the housing base including;

a housing base floor including ports through which air may flow to the carburetor and means by which the housing base may be attached to the carburetor;

a housing base perimeter wall integral with the housing base floor and extending, generally, perpendicularly from the perimeter of the housing base floor in the direction of the housing cover, the housing base perimeter wall having an inside surface and an outside surface, the inside surface of the housing base perimeter wall and the housing base floor defining a housing base interior, and the housing base perimeter wall including an anterior section, a posterior section, a first lateral section joining one terminus of the anterior section to one terminus of the posterior section and a second lateral section joining the other terminus of the anterior section to the other terminus of the posterior section such that when the housing is installed in the portable power tool the anterior section is nearest the front of the power tool, the posterior section is nearest the rear of the power tool and the first and second lateral sections are disposed toward opposite sides of the power tool; an augmentation integral with the first lateral section of the housing base perimeter wall, the augmentation extending, substantially perpendicularly from the housing base floor in a direction away from the housing cover;

a pair of opposed support legs for securing the housing base to the chassis of the portable power tool, a first of the opposed support legs being integral with the augmentation and the second of the opposed support legs being integral with the second lateral section of the housing base wall;

a mounting element integral with the outside surface of the first lateral section of the housing base perimeter wall for the mounting thereon of an ignition switch for the portable power tool; a choke lever connected to an air valve for controlling the flow of air to the carburetor, the choke lever being reciprocally movable between a first position in which air flow to the carburetor of the portable power tool is not substantially restricted and a second position in which air flow to the carburetor is substantially restricted, the choke lever including a depending abutment;

an ignition switch positioned on the mounting element so as to be movable between a run position in which the power tool may be operated and a stop position in which the power tool may not be operated, the ignition switch including a depending abutment located in the line of reciprocal movement of the depending abutment of the choke lever when the ignition switch is in the stop position so that reciprocal movement of the choke lever from the first position to the second position causes the depending abutment on the choke lever to engage the depending abutment on the ignition switch and move the ignition switch from the stop position to the run position; and a leaf spring engaging the ignition switch at a first site of engagement on the ignition switch when the ignition switch is in the stop position and engaging the ignition switch at a second site of engagement on the ignition switch when the ignition switch is in the run position, the leaf spring being biased for alternatively applying a force to the ignition switch at the first and second sites of engagement in a direction toward the mounting element and away from the choke lever.

32. The ignition system of claim 31, wherein the mounting element comprises a, generally, cylindrical projection that extends, generally, perpendicularly from the first lateral section of the housing base perimeter wall outwardly of the housing base interior.

33. The ignition system of claim 32, including a pair of positioning elements integral with the augmentation and located between the mounting element and the anterior section of the housing base perimeter wall, the positioning elements being separated from one another so as to establish a space into which the intermediate section of an S-shaped leaf spring is placed, each positioning element having an engaging surface adapted to engage the S-shaped leaf spring at a respective location at which the intermediate section of the S-shaped leaf spring is joined to the first and second terminal sections of the S-shaped leaf spring.

34. The ignition system of claim 33, wherein the leaf spring forms a part of the ignition circuit, and the continuity of the ignition circuit is established when the first terminal section of the leaf spring engages the ignition switch at the first site of engagement and the continuity of the ignition circuit is interrupted when the first terminal section of the leaf spring engages the ignition switch at the second site of engagement.

35. The ignition system of claim 34, wherein the second terminal section of the leaf spring is connected to the ignition circuit and the ignition switch includes an electrical conductor located at the first site of engagement on the ignition switch and connected to the ignition circuit.

36. The ignition system of claim 35, wherein the first terminal section of the leaf spring includes a rounded protuberance that alternately engages the ignition switch at the first and second sites of engagement.

37. The ignition system of claim 36, wherein the ignition switch includes a, substantially, circular opening and the electrical conductor comprises an annulus that is press-fitted in the substantially circular opening.

38. The ignition system of claim 37, including positioning means located adjacent the substantially circular opening in the ignition switch for maintaining the electrical conductor in place in the substantially circular opening in the ignition switch.

39. The ignition system of claim 38, including a stop lug for limiting the pivotal movement of the ignition switch beyond the position placing the power tool in the run position, the stop lug being integral with the outer surface of the first lateral section of the housing base perimeter wall and located between the cylindrical projection and the posterior section of the housing base perimeter wall.

40. The ignition system of claim 39, including a guide lug integral with the outer surface of the first lateral section of the housing base perimeter wall and located between the stop lug and the posterior section of the housing base perimeter wall for providing a guiding surface for the carburetor choke lever.

41. The ignition system of claim 40, wherein the housing cover rests on the housing base and includes a depending portion that extends downwardly over the anterior section of the housing base perimeter wall adjacent the location where the anterior section is joined to the first lateral section of the housing base perimeter wall and beyond the housing base floor so as to protect the electrical wiring components connected to the first and second terminal sections of the leaf spring.

42. The ignition system of claim 41, including access holes through the augmentation and the opposed support leg that is integral with the augmentation for providing access to needles on the carburetor.

43. The ignition system of claim 42, wherein a portion of the first lateral section of the housing base perimeter wall that is adjacent the posterior section of the housing base perimeter wall is recessed inwardly toward the housing base interior, the augmentation is located, substantially, in the same plane as the portion of the first lateral section of the housing base perimeter wall that is recessed, and the cylindrical projection, the stop lug and the guide lug are all located on the portion of the first lateral section of the housing base perimeter wall that is recessed.

* * * * *